United States Patent [19]

Kobayashi et al.

[11] 4,274,816

[45] Jun. 23, 1981

[54] ROTARY VANE COMPRESSOR WITH CHAMFERED VANE SLOTS

[75] Inventors: Shigeru Kobayashi; Takemi Kanda; Tsunenori Shibuya, all of Konan, Japan

[73] Assignee: Diesel Kiki Company, Ltd., Tokyo, Japan

[21] Appl. No.: 52,775

[22] Filed: Jun. 28, 1979

[30] Foreign Application Priority Data

Aug. 31, 1978 [JP] Japan ..... 53-119802[U]

[51] Int. Cl.[3] ..... F04C 18/00; F04C 29/00; F04C 29/02

[52] U.S. Cl. ..... 418/93; 418/238; 418/269

[58] Field of Search ..... 418/82, 93, 259, 266–269, 418/236, 238

[56] References Cited

U.S. PATENT DOCUMENTS

| | | | |
|---|---|---|---|
| 3,221,665 | 12/1965 | Hartmann | 418/268 |
| 3,385,514 | 5/1968 | Kilgore et al. | 418/82 |
| 3,767,335 | 10/1973 | Kramer et al. | 418/259 |
| 3,981,647 | 9/1976 | Schoeps | 418/259 |

FOREIGN PATENT DOCUMENTS

| | | | |
|---|---|---|---|
| 552960 | 2/1923 | France | 418/266 |
| 62601 | 2/1955 | France | 418/266 |
| 103202 | 11/1962 | Netherlands | 418/267 |

*Primary Examiner*—John J. Vrablik
*Attorney, Agent, or Firm*—David G. Alexander

[57] ABSTRACT

A rotor (18) is disposed in a bore (14) of a cylinder (13) and carries vanes (33), (34), (36), (37) in radial slots (28), (29), (31), (32), the vanes (33), (34),(36), (37) being urged into engagement with the wall of the bore (14) by oil pressure applied to inner ends of the vanes (33), (34), (36), (37). The cylinder (13), rotor (18) and vanes (33), (34), (36), (37) are configured to displace refrigerant fluid or the like through the bore (14) from an inlet (19), (21) to an outlet (22), (23) upon rotation of the rotor (18). The trailing outer edges **(28*a*′) of the slots (28), (29), (31), (32) are chamfered, thus reducing frictional resistance between the vanes (33), (34), (36), (37) and slots (28), (29), (31), (32) to radial movement and producing a reservoir (28*c*′) for oil forced through clearances between the slots (28), (29), (31), (32) and vanes (33), (34), (36), (37).**

2 Claims, 4 Drawing Figures

ROTARY VANE COMPRESSOR WITH CHAMFERED VANE SLOTS

BACKGROUND OF THE INVENTION

The present invention relates to a rotary vane compressor. Such compressors are well known in the art and are widely used in refrigeration and air conditioning systems and the like due to their many advantages. These compressors comprise a cylinder formed with a bore and an inlet and outlet communicating with the bore. A rotor is disposed in the bore and formed with a plurality of radial grooves or slots in which vanes are slidably disposed. The vanes are urged by centrifugal force, spring force, oil pressure or a combination thereof into sealing engagement with the inner wall of the bore. The bore may be non-circular and the rotor mounted coaxially therein. Alternatively, the bore may be circular and the rotor mounted eccentrically therein. In either case, rotation of the rotor and vanes as an integral unit causes compressive displacement of refrigerant or other fluid from the inlet to the outlet through the bore since the rotating vanes define pressure chambers of changing volume.

It is advantageous to apply a fluid lubricant such as oil to the inner ends of the vanes under pressure and provide a clearance between the sides of the vanes and the adjacent walls of the slots. The oil serves the dual function of urging the vanes against the wall of the bore and also penetrating through the clearances between the vanes and slots to lubricate the vanes and adjacent walls of the slots. The oil also serves to prevent leakage of refrigerant fluid past the vanes.

However, due to the frictional resistance between the outer edges of the vanes and the wall of the bore, the vanes are urged to tilt backwardly, or opposite to the direction of movement of the rotor. Due to the clearances between the vanes and slots, the trailing surfaces of the vanes pressingly engage with the sharp trailing outer edges of the slots. This produces frictional resistance to radial movement of the vanes in the slots and degrades the torque of the compressor. In addition, the sharp trailing outer edges of the slots scrape oil off the vanes, thereby increasing the coefficient of friction between the vanes and slots and thereby the frictional resistance to radial movement. This increased friction contributes to excessive wear of the vanes and slots and in the worst case situation may cause the vanes to freeze or stick in the slots, resulting in failure of the compressor.

SUMMARY OF THE INVENTION

A rotary compressor embodying the present invention includes a cylinder having a bore and an inlet and outlet communicating with the bore, a rotor rotatably disposed in the bore and formed with a plurality of radial slots, and a plurality of vanes slidably disposed in the slots respectively and being urged into engagement with a wall of the bore, the cylinder, rotor and vanes being configured in such a manner that fluid is displaced from the inlet to the outlet through the bore upon integral rotation of the rotor and vanes, and is characterized in that trailing outer edges of the slots are chamfered.

In accordance with the present invention, a rotor is disposed in a bore of a cylinder and carries vanes in radial slots, the vanes being urged into engagement with the wall of the bore by oil pressure applied to inner ends of the vanes. The cylinder, rotor and vanes are configured to displace refrigerant fluid or the like through the bore from an inlet to an outlet upon rotation of the rotor. The trailing outer edges of the slots are chamfered, thus reducing frictional resistance between the vanes and slots to radial movement and producing a reservoir for oil forced through clearances between the slots and vanes.

It is an object of the present invention to provide a rotary vane compressor which overcomes the problems of friction and sticking of vanes in slots of a rotor.

It is another object of the present invention to provide a rotary vane compressor which is smoother and more reliable in operation than rotary compressors known heretofore.

It is another object of the present invention to provide a rotary vane compressor in which trailing outer edges of slots in a rotor are chamfered to reduce frictional resistance and provide a reservoir for oil.

It is another object of the present invention to provide a generally improved rotary vane compressor.

Other objects, together with the foregoing, are attained in the embodiment described in the following description and illustrated in the accompanying drawing.

DESCRIPTION OF THE PREFERRED EMBODIMENT

While the rotary vane compressor of the present invention is susceptible of numerous physical embodiments, depending upon the environment and requirements of use, substantial numbers of the herein shown and described embodiment have been made, tested and used, and all have performed in an eminently satisfactory manner.

Figure 1:
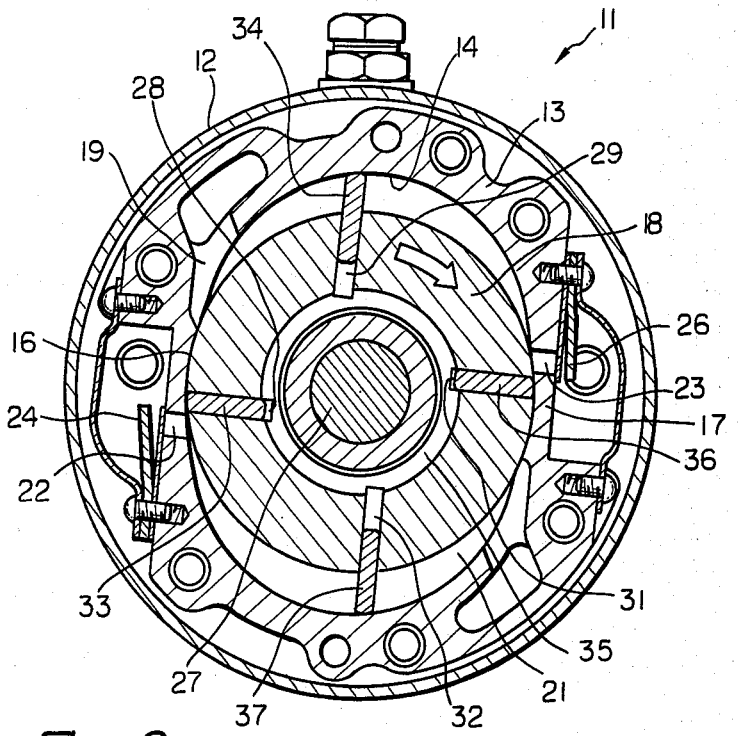
Fig. 1 PRIOR ART
FIG. 1 is a sectional view of a prior art rotary vane compressor to which the present invention constitutes a novel improvement.

Referring now to FIG. 1 of the drawing, a prior art rotary vane compressor is generally designated by the reference numeral 11 and comprises a housing 12. A cylinder or cam ring 13 is fixedly mounted inside the housing 12 and is formed with a generally elliptical bore 14. A rotor 18 having a circular cross section is rotatably mounted in the bore 14 in a coaxial relation and is sealingly tangent to the wall of the bore 14 at points 16 and 17. The cylinder 13 is formed with inlets 19 and 21 and outlets 22 and 23 which communicate with the bore 14. Outlet check valves in the form of flapper valves 24 and 26 are provided to the outlets 22 and 23 respectively to allow flow only out of the outlets 22 and 23.

The rotor 18 is mounted on a shaft 27 and is formed with radial slots 28, 29, 31 and 32. Vanes 33, 34, 36 and 37 are slidably retained in the slots 28, 29, 31 and 32 respectively. Pressurized lubricating oil is introduced into an annular chamber 35 and thereby acts on the inner edges or ends of the vanes 33, 34, 36 and 37 and urges the same radially outwardly into sealing engagement with the wall of the bore 14. This action is aided by centrifugal force upon rotation of the rotor 18. The pressure for pressurizing the oil is preferably derived from outlet pressure of the compressor 11.

In operation, a fluid to be compressed, for example refrigerant fluid in an air conditioning system, is fed to the inlets 19 and 21 and the rotor 18 and vanes 33, 34, 36 and 37 driven for integral clockwise rotation. Due to the elliptical configuration of the bore 14, fluid chambers (not designated) defined between the walls of the bore 14 and rotor 18 in conjunction with adjacent vanes 33, 34, 36 and 37 change in volume. The inlets 19 and 21 are spaced in such a manner that the volume of the fluid chambers increases while in communication with the inlets. The increasing volume sucks refrigerant fluid into the chambers through the inlets 19 and 21.

Conversely, the outlets 22 and 23 are spaced so that the volume of the fluid chambers decreases while the chambers are in communication with the outlets 22 and 23. This decreasing volume forces the refrigerant fluid out of the outlets 22 and 23 at elevated pressure. The result of these operations is that the refrigerant fluid is compressively displaced from the inlets 19 and 21 through the bore 14 to the outlets 22 and 23.

Figure 2:
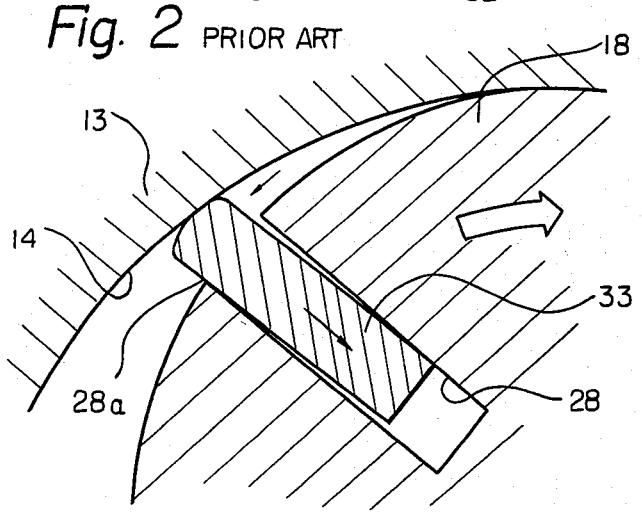
Fig. 2 PRIOR ART
FIG. 2 is a fragmentary sectional view, to an enlarged scale, of a vane, rotor, slot and cylinder arrangement of the prior art compressor.

FIG. 2 is an enlarged view illustrating the rotor 18, bore 14, vane 33 and slot 28. Since the rotor 18 is rotated clockwise, the frictional force between the outer end or edge of the vane 33 and the wall of the bore 14 causes the vane 33 to be tilted backwardly, or counterclockwise in the slot 28. As a result, the trailing (left) side of the vane 33 pressingly engages with a sharp trailing outer edge 28*a* of the slot 28. This causes a high stress concentration and frictional resistance to radial movement between the vane 33 and edge 28*a* of the slot 28 which leads to sticking, wear and other undesirable effects discussed above. The vane 33 is allowed to tilt due to the fact that a clearance is provided between the vane 33 and the walls of the slot 28 to allow oil to penetrate through the clearance and lubricate the vane 33 and adjacent walls of the slot 28.

Figure 3:
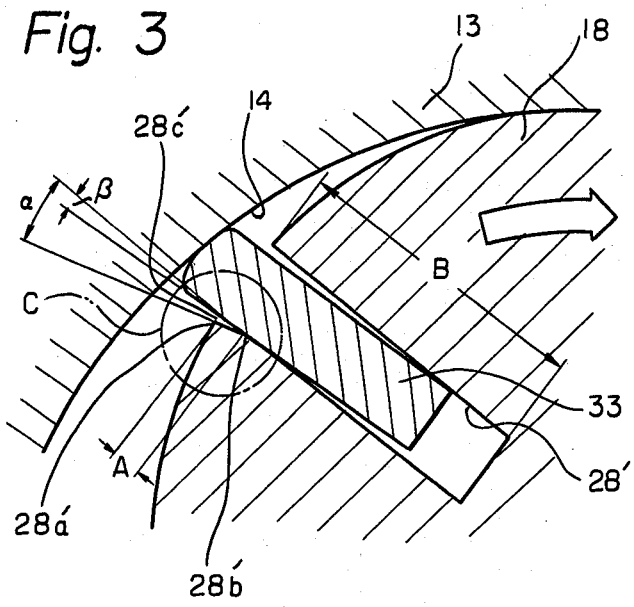
FIG. 3 is similar to FIG. 2 but illustrates the improvement of the present invention.
Figure 4:
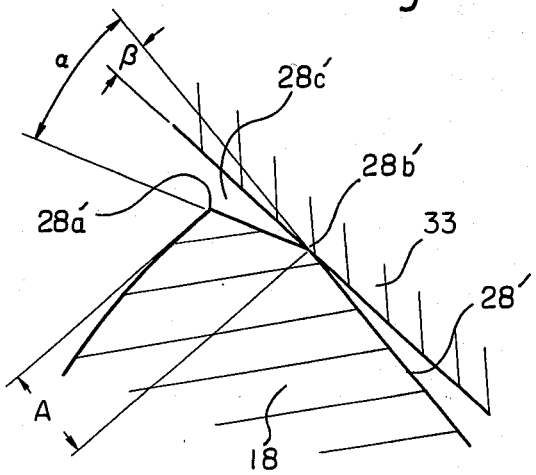
FIG. 4 is an enlarged view of an area encircled by a broken line C in FIG. 3.

FIGS. 3 and 4 illustrate how these problems are overcome in accordance with the present invention by chamfering the trailing outer edge 28*a* of the slot 28. The slot and trailing outer edge are redesignated in FIGS. 3 and 4 as 28' and 28*a'* respectively.

The chamfering of the edge 28*a'* serves two function. First, the vane 33 does not engage with the sharp outermost portion of the edge 28*a'* but with a bottom edge of the chamfering which is designated as 28*b'*. The angle of contact between the vane 33 and edge 28*b'* is a large obtuse angle, and therefore the corfficient of friction between the vane 33 and slot 28' is greatly reduced over the prior art. This positively precludes excessive friction and underlubrication between the vane 33 and walls of the slot 28' as occurs in the prior art. As yet another advantage, the chamfering provides a reservoir 28*c'* for oil accumulated in the associated fluid chamber during the compression portion of the operating cycle.

It has been determined that the chamfering is most effective when configured as follows. Assuming that the depth of the slot 28' is designated as B, the depth of the chamfering, designated as A, is selected to be in the range from B times 0.01 to B times 0.30.

It will be further assumed that the clearance between the vane 33 and slot 28 is such that the vane 33 is allowed to tilt by an angle $\beta$ during operation of the compressor. An angle of chamfering, designated as $\alpha$, is selected to be in the range between $\beta$ plus 0.5° to $\beta$ plus 1.5°. These values produce the best results in practical application.

In summary, it will be seen that the present invention overcomes the drawbacks of the prior art and provides a rotary vane compressor which is free from sticking of vanes, loss of torque and other undesirable effects which are inherent in the prior art. Various modifications will become possible for those skilled in the art after receiving the teachings of the present disclosure without departing from the scope thereof. For example, the leading outer edges of the slots may be chamfered in addition to the trailing outer edges, although not illustrated.

What is claimed is:

1. A rotary compressor including a cylinder having a bore and an inlet and outlet communicating with the bore, a rotor rotatably disposed in the bore and formed with a plurality of radial slots, and a plurality of vanes slidably disposed in the slots respectively and being urged into engagement with a wall of the bore, the cylinder, rotor and vanes being configured in such a manner that fluid is displaced from the inlet to the outlet through the bore upon integral rotation of the rotor and vanes, characterized in that trailing outer edges of the slots are chamfered; and further comprising means for urging the vanes into engagement with the wall of the bore by applying pressurized fluid lubricant to inner ends of the vanes, clearances being provided between the vanes and respective slots which are sufficiently large to allow lubrication of the vanes and adjacent walls of the slots;

said clearances allowing tilting of the vanes in the slots by a predetermined angle, an angle of chamfering of the trailing outer edges of the slots being in the range from the predetermined angle plus 0.5° to the predetermined angle plus 1.5°.

2. A compressor as in claim 1, in which the slots have a predetermined depth, a depth of chamfering of the trailing outer edges of the slots being in the range from the predetermined depth times 0.01 to the predetermined depth times 0.30.

* * * * *